US006111355A

United States Patent [19]

Inoue et al.

[11] Patent Number: 6,111,355

[45] Date of Patent: Aug. 29, 2000

[54] THIN FILM EL PANELS AND A METHOD FOR PRODUCING THE SAME

[75] Inventors: Satoshi Inoue, Tenri; Mikihiro Noma, Nara, both of Japan

[73] Assignee: Sharp Kabushiki Kaisha, Osaka, Japan

[21] Appl. No.: 08/966,031

[22] Filed: Nov. 7, 1997

[30] Foreign Application Priority Data

Nov. 27, 1996 [JP] Japan ..... 8-315771

[51] Int. Cl.[7] ..... H05B 33/02

[52] U.S. Cl. ..... 313/506; 313/292

[58] Field of Search ..... 313/498, 112, 313/506, 509, 292, 512; 315/169.3

[56] References Cited

U.S. PATENT DOCUMENTS 4,954,746 9/1990 Taniguchi et al. ..... 313/509 X

FOREIGN PATENT DOCUMENTS 63-64082 3/1988 Japan .
5-94879 4/1993 Japan .
5-38677 5/1993 Japan .

*Primary Examiner*—Ashok Patel
*Attorney, Agent, or Firm*—Nixon & Vanderhye, P.C.

[57] ABSTRACT

A thin film EL panel includes: an EL element substrate having a thin film EL element with a plurality of pixels; a color filter substrate having a color filter and being disposed opposite to the EL element substrate through a gap; and a seal resin for sealing the gap formed on the periphery of the display region. A spacer having a particle size of 15 to 120 μm is interposed in the gap between the EL element and the color filter substrate.

6 Claims, 4 Drawing Sheets

THIN FILM EL PANELS AND A METHOD FOR PRODUCING THE SAME

BACKGROUND OF THE INVENTION

1. Field of the Invention

The present invention relates to thin film EL (electroluminescence) panels, and in particular to filter-mode thin film EL panels comprising a combination of a thin film EL panel and a color filter.

2. Description of the Related Art

Recently, a filter-mode thin film EL panel comprising a thin film EL element and a color filter, both of which are oppositely disposed to each other, has been developed so as to provide a multi-color thin film EL panel. A filter-mode is such a mode that a single-color light exiting from the thin film EL element is distributed by a color filter comprising a plural color organic material to provide a plurality of luminescent colors. Since a single-color luminescent layer may be formed on the EL element in the filter-mode thin film EL panel, it is possible to simplify the production process. However, a gap between the EL element and the color filter causes a viewing angle dependency (the so-called color unevenness). Thus, the thin film EL panel has hitherto been formed in such a manner that both the EL element and the color filter are placed as close as possible without placing anything therebetween.

However, because the above-described conventional thin film EL panel is formed in such a manner that the EL element and the color filter come close, the EL element and the color filter may be brought into contact together to create scratches when the color filter is aligned with the pixel in its manufacturing step.

Also, because the EL element has such a feature that it is repeatedly expanded and contracted in the width direction during its operation (in an alternating current driving mode), the EL element is partially brought into contact with the color filter in the production step, thereby creating pixel defects due to dielectric breakdown and linear defects due to the breakage of the electrodes.

For that reason, the present applicant has proposed in Japanese Laid-open Publication No. 5-94879 a method for forming a spacer having a light shading property and projected at about a right angle to the surface of a substrate between the adjacent pixels of the above-described EL element.

However, the spacer according to the technology of the above-described patent publication is a resin-type spacer obtained by forming a resin on the entire surface of the EL element by a rotational coating method, and thereafter leaving only a portion of the resin formed between the adjacent pixels of the EL element by photolithography, etc. Therefore, its production process is complicated due to the increased number of steps. Consequently, the thin film EL panel according to the technology of the above-described patent publication is not satisfactory due to its complicated production process, and the process for producing this thin film EL panel is not the optimum process.

SUMMARY OF THE INVENTION

According to one aspect of this invention, a thin film EL panel includes: an EL element substrate having a thin film EL element with a plurality of pixels; a color filter substrate having a color filter and being disposed opposite to the EL element substrate through a gap; and a seal resin for sealing the gap formed on the periphery of the display region. A spacer having a particle size of 15 to 120 $\mu$m is interposed in the gap between the EL element and the color filter substrate.

In one embodiment of the present invention, the application density of the spacer is 0.01 to 10 particles/mm$^2$.

In another embodiment of the present invention, the seal resin is a thermosetting resin, and the thermal decomposition temperature of said spacer is higher than the thermosetting temperature of the thermosetting resin.

In still another embodiment of the present invention, the spacer is fixed on the EL element.

In still yet another embodiment of the present invention, the EL element comprises a lower electrode, a lower insulating film, an EL layer, an upper insulating film and an upper electrode successively laminated on a substrate.

In still yet another embodiment of the present invention, the spacer is fixed between the adjacent upper electrodes of the EL element.

According to another aspect of this invention, a process for producing thin film EL panels includes the steps of: successively laminating a lower electrode, a lower insulating film, an EL layer, an upper insulating film and an upper electrode on a substrate to form an EL element having a plurality of pixels; forming an adhesive layer between the adjacent upper electrodes of the EL element; applying a spacer on the EL element; and removing the spacer applied on the pixel of the EL element.

In one embodiment of the process of the present invention, the spacer is adhered to the adhesive layer.

In another embodiment of the process of the present invention, the particle size of the spacer is 15 to 120 $\mu$m.

In still another embodiment of the process of the present invention, the application density of the spacer is 0.01 to 10 particles/mm$^2$.

According to still another aspect of this invention, a process for producing thin film EL panels includes the steps of: successively laminating a lower electrode, a lower insulating film, an EL layer, an upper insulating film and an upper electrode on a substrate to form an EL element; supplying a certain charge to the upper electrode of the EL element; imparting the same polarity charge as that given in the upper electrode to a spacer later applied on the EL element; and applying the spacer on the EL element.

In one embodiment of the process of the present invention, the particle size of the spacer is 15 to 120 $\mu$m.

In another embodiment of the process of the present invention, the application density of the spacer is 0.01 to 10 particles/mm$^2$.

In still another embodiment of the process of the present invention, the spacer has a thermoplastic resin on its surface.

The following illustrate the functions achieved with the above-described structure.

According to the thin film EL panel of the present invention, a gap between the EL element and the color filter is ensured in the manufacturing and production steps by interposing a spacer having a particle size of 15 $\mu$m or more between the EL element and the color filter, so that these are not brought into contact. Therefore, it is possible to prevent generation of pixel defects due to scratches and dielectric breakdown, linear defects, and the like. Also, it is possible to prevent generation of color unevenness and to improve viewing angle dependency, i.e., to ensure a viewing angle of 140° or more by limiting the particle size of the spacer to 120 $\mu$m or less, thereby obtaining a thin film EL panel having good viewing angle characteristics.

Also, it is possible to prevent contact between the EL element and the color filter caused by a partial bending of the color filter substrate by limiting the application density of the spacer to at least 0.01 particles/$m^2$. It is also possible to prevent the upper electrode from breaking in this manner by limiting an application density of the spacer to 10 particles/$mm^2$.

Moreover, it is possible to prevent the components of the spacer from dissolving into an insulating liquid by using a spacer having a thermal decomposition temperature higher than the curing temperature of the seal resin, which makes it possible to improve the reliability of the EL element.

Further, it is possible to prevent the spacer from migrating and being distributed unevenly during the injection of an insulating oil into a gap between the EL element substrate and the color filter substrate by fixing the spacer on the EL element.

Since the EL element is subject to any minute defects generated in its pixel, it is desirable that the spacer be fixed between the adjacent upper electrodes of the EL element. It is possible to prevent any minute breakages from being generated on the pixel of the EL element by fixing the spacer between the adjacent upper electrodes of the EL element.

According to the process for producing the thin film EL panel of the present invention, it is possible to readily fix the spacer between the adjacent upper electrodes of the EL element by forming an adhesive layer between the adjacent upper electrodes of the EL element or between the adjacent color filters of the color filter substrate, and thereafter applying the spacer thereon. Also, it is possible to readily fix the spacer between the adjacent upper electrodes of the EL element without increasing the production steps by imparting the same polarity charge to both the upper electrode of the EL element and the spacer, and thereafter applying the spacer on the EL element substrate.

DESCRIPTION OF THE PREFERRED EMBODIMENTS

Embodiment 1

One embodiment of the present invention is illustrated with reference to FIGS. 1–4.

Figure 1:
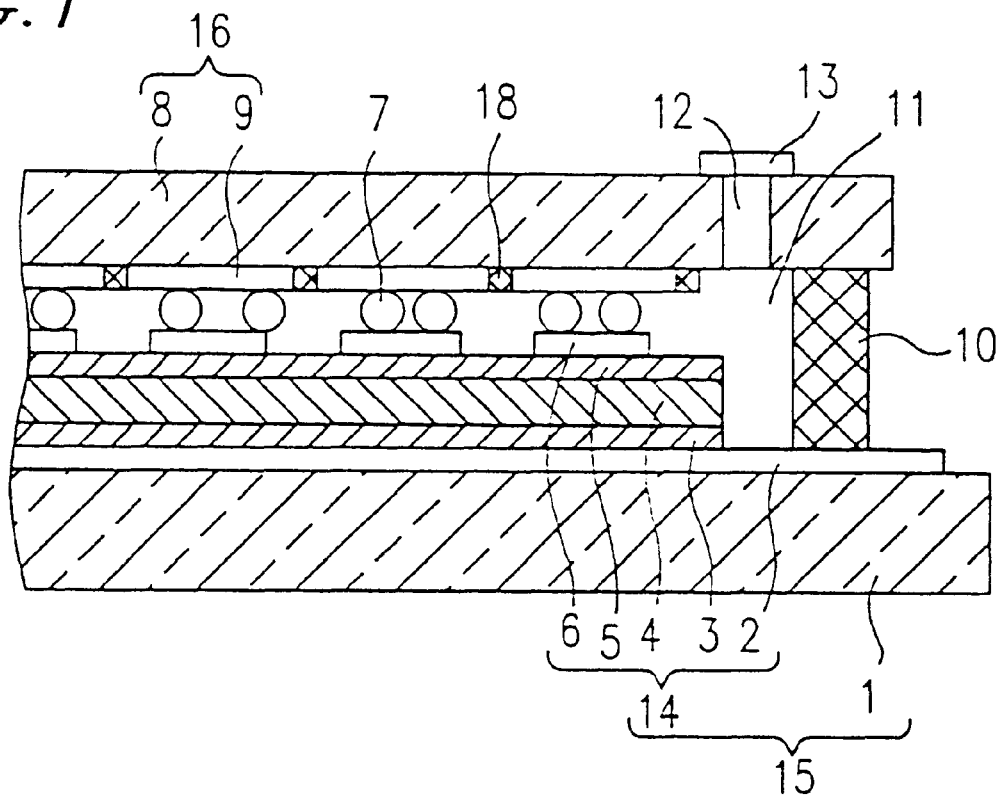
FIG. 1 is a sectional view showing one embodiment of the thin film EL panel of the present invention.

FIG. 1 is a sectional view showing a thin film EL panel of this embodiment, wherein 1 is an insulating substrate, 2 is a lower electrode, 3 is a lower insulating film, 4 is an EL layer, 5 is an upper insulating film, and 6 is an upper electrode. The lower electrode 2, the lower insulating film 3, the EL layer 4, the upper insulating film 5 and the upper electrode 6 constitute an EL element 14, and this EL element 14 and the insulating substrate 1 constitute an EL element substrate 15. Also, 8 is a transparent substrate and 9 is a color filter, both of which constitute a color filter substrate 16. The lower electrode 2 and the upper electrode 6 are placed at a right angle to each other to form a stripe shape. A pixel is formed in a crossing section of the lower electrode 2 and the upper electrode 6. Also, a black mask 18 is formed in a gap between the color filters 9 of the color filter substrate 16.

The EL element substrate 15 is superposed on the color filter substrate 16 through a seal resin 10 which is formed in the periphery of the display region. Also, an insulating liquid 11 is injected into a gap between the EL element substrate 15 and the color filter substrate 16 to protect the EL element 14 which is susceptible to humidity. The insulating liquid 11 is injected between the substrates from an inlet 12 which is formed on the color filter substrate 16, and sealed by a sealing plate 13.

Also, a spacer 7 is disposed on the display region of the EL element substrate 15 to maintain a certain gap between the EL element 14 and the color filter 9, thereby preventing contact between the EL element 14 and the color filter 9 to eliminate any defects in the production process as well as the manufacturing step.

A granular spacer 7 is used in this embodiment. It is necessary to slightly migrate the EL element substrate 15 and the color filter substrate 16 so as to precisely align the color filter 9 after the EL element substrate 15 is superposed on the color filter substrate 16. Therefore, if the spacer 7 has a distorted shape, it may hurt the EL element 14 and the color filter 9 during the alignment of the color filter 9.

Figure 2:
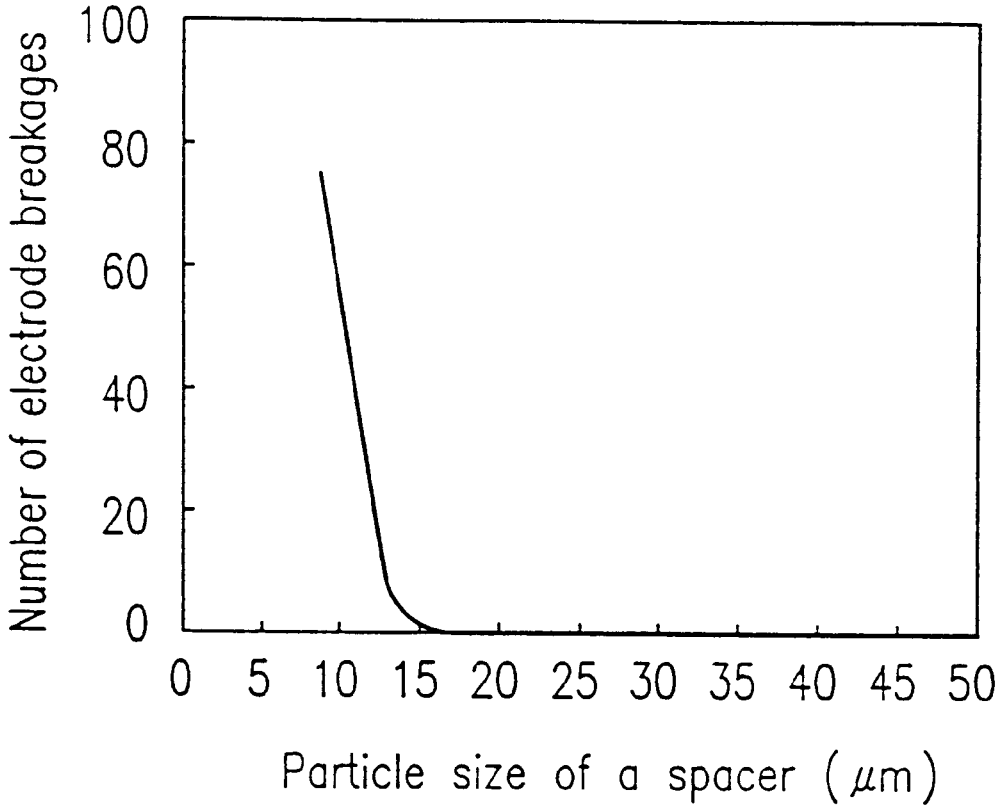
FIG. 2 is a graph showing the relationship between the particle size of a spacer and the number of electrode breakages.

It is necessary that the particle size of the spacer 7 be optimally selected, because the rate of defect occurrence and the viewing angle characteristics vary depending upon its size. Practically, a thin film EL panel requires aging. Aging is a treatment of applying an AC pulse voltage having a suitable amplitude for a certain period in order to stabilize the element characteristics such as the brightness, the luminescent initiating voltage and the like of the thin film EL panel. No study has yet been made in consideration of the practicality of a thin film EL panel having the structure shown in FIG. 1. Thus, a gap between the EL element substrate 15 and the color filter 16 has been, for example, as narrow as 2 $\mu$m. The thin film EL panel is subjected to aging for 100 hours in the present invention which is a practically sufficient period. FIG. 2 shows the results. FIG. 2 is a graph showing a relationship between the particle size of the spacer 7 and the number of electrode breakages. According to FIG. 2, we have found that mostly no breakage appears, when a gap between the EL element substrate 15 and the color filter substrate 16 is 15 $\mu$m or more. Even when the gap is less than 15 $\mu$m, electrode breakage may not occur after using for a very short period of time without being subjected to aging. However, electrode breakage has occurred when it is subjected to aging for a long period of time. This is because the thin film EL panel generates heat due to the aging to gradually create fine breakage points (BP) accompanied by the heat. Thus, a method of solving the above-described problem has been found in the present invention by setting the gap at 15 $\mu$m or more. Also, the commercially available Micropearl SP manufactured by Sekisui Fine Chemical, Corp. is preferably used as the spacer 7. This method provides such a very high precision that the setting value error of the gap is ±0.05 $\mu$m, and enables precise and ready control of the gap between the EL element substrate 15 and the color filter substrate 16. Where a resin is instead used as the spacer 7, it is impossible to control the gap with such high precision due to the generation of coating spots. Since it is apparent from FIG. 2 that the number of breakages is less when the particle size of the spacer 7 is 15 $\mu$m or more, it is preferred that the particle size of the spacer 7 be 15 μm or more.

Figure 3:
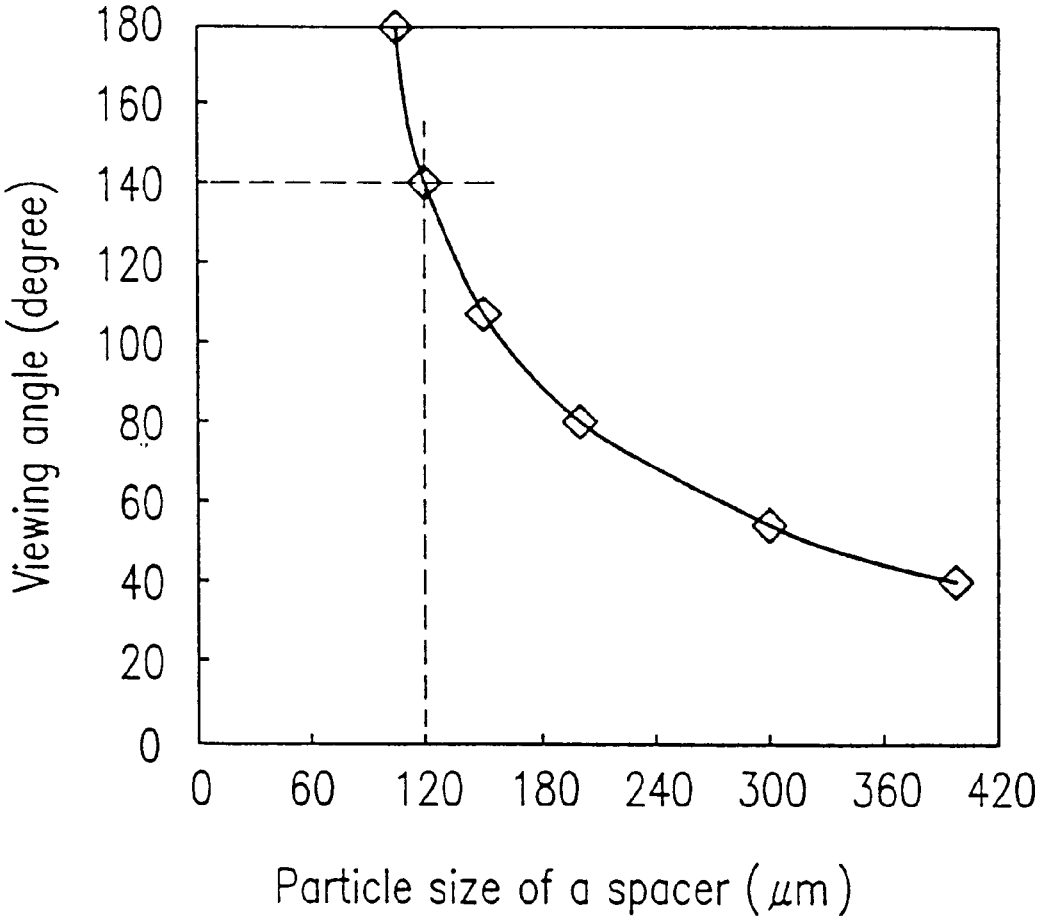
FIG. 3 is a graph showing the relationship between the particle size of a spacer and the viewing angle.

FIG. 3 is a graph showing a relationship between the particle size of the spacer 7 and a viewing angle characteristic in a standard pitch thin film EL panel. In the above-described standard pitch thin film EL panel, the width of each of the lower and upper electrodes is 460 μm, the gap between the electrodes is 140 μm, the stripe width of the color filter is 560 μm, and the gap between the color filters is 40 μm. According to FIG. 3, if the particle size of the spacer 7 is 120 μm or less, a viewing angle of 140° or more can be obtained, which makes it possible to use this thin film EL panel without any practical problems. Therefore, it is preferred that the particle size of the spacer 7 be 120 μm or less. Also, the spacer 7 having a particle size of more than 120 μm causes no problem during a short aging period, but it may cause enlarged breakage points during long-term aging. However, we have found that when the particle size is 120 μm or less, the breakage points are not prominent. Also, when the particle size of the spacer 7 is more than 120 μm, it is very difficult to uniformly and quantitatively apply the spacer 7 due to its heavy weight. Therefore, it is desirable that the particle size of the spacer 7 be 15 μm to 120 μm.

Also, it is preferred that the application density of the spacer 7 be optimally selected, because the rate of defect occurrence varies depending upon its value. If the application density is too low, a region having no spacer 7 appears, and the EL element substrate 15 and the color filter substrate 16 are bent in this region to create the contact of the EL element 14 and the color filter 9, thereby causing the generation of electrode breakages. Also, if the application density is too high, the spacer 7 may be aggregated. Generally, there are local regions which are liable to cause minute breakages in the EL element 14, and the expansion of the breakage is prevented by the design of the production process. However, when an aggregation of the spacer 7 exists at the minute breakage location, the minute breakage tends to expand to often cause electrode breakages. Therefore, it is necessary to eliminate the generation of aggregations of the spacer 7.

Figure 4:
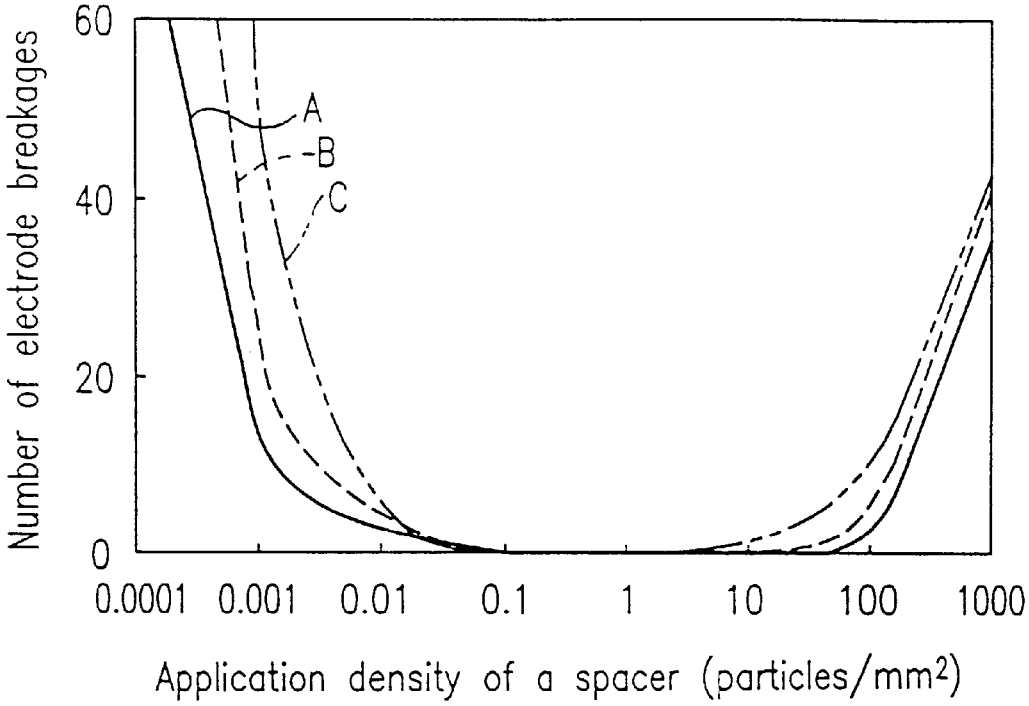
FIG. 4 is a graph showing the relationship between the application density of a spacer and the number of electrode breakages.

FIG. 4 is a graph showing the relationship between the application density of the spacer 7 and the number of electrode breakages, wherein the curve A indicates a case where the thin film EL panel is subjected to aging for 20 hours, the curve B indicates a case where it is subjected to aging for 100 hours, and the curve C indicates a case where it is subjected to aging for 200 hours. It can be seen from FIG. 4 that it is possible to maintain the number of electrode breakages at a lower level, if the application density of the spacer 7 is 0.01 particles/$mm^2$ or more, preferably 0.1 particles/$mm^2$ or more. Also, the number of electrode breakages can be lowered for short-term uses, if the application density of the spacer 7 is 100 particles/$mm^2$ (the curve A). On the other hand, the number of electrode breakages can be lowered for long-term uses, if the application density of the spacer 7 is 10 particles/$mm^2$, preferably 1 particles/$mm^2$ (the curves B and C).

Also, since the substrates are exposed to high temperatures in order to cure the seal resin 10 after disposing the spacer 7 in the production step of the thin film EL panel in a case where a thermosetting resin is used as the seal resin 10, it is necessary that the thermal decomposition temperature of the spacer 7 be higher than the thermosetting temperature of the seal resin 10. This is because where the thermal decomposition temperature of the spacer 7 is less than the setting temperature of the seal resin 10, the components of the spacer 7 will be melted or dissolved into the insulating liquid 11 to adversely affect the EL element 14.

The following illustrate a process for producing the thin film EL panel according to this embodiment.

First, a lower electrode 2 is formed in a stripe shape on an insulating substrate 1 made from glass, and the like. Then, a lower insulating film 3 comprising $SiO_2$ and $Si_3N_4$, an EL layer 4 comprising ZnS:Mn, and an upper insulating film 5 comprising $Si_3N_4$ and $SiO_2$ are successively laminated thereon. Finally, a stripe-shaped upper electrode 6 comprising a transparent conductive material such as ITO (Indium Tin Oxide) and the like is formed at a right angle to the lower electrode 2. Examples of a material for the lower electrode 2 include ITO, elemental substances such as Ta, Mo, W and the like, and combinations thereof. Additionally, the upper insulating film 5 may contain $Al_2O_3$.

On the EL element substrate thus formed, plastic beads having a particle size of 20 μm are applied as a spacer 7 using a dry application device. Examples of such spacer include Micropearl SP (manufactured by Sekisui Fine Chemical, Corp.).

Separately, color filters 9 of red (R) and green (G) are formed on a transparent substrate 8 in a stripe shape by a photolithography method using materials comprising a red pigment and a green pigment dispersed in a photosensitive resin, respectively. Then, the first formed red color filter is slightly superposed with the later formed green color filter outside of the pixel region to provide a black mask 18. Although a flat glass substrate is used as the transparent substrate 8 in this embodiment, an engraved glass substrate may instead be used.

The color filter substrate 16 thus formed is superposed on the EL element substrate 15 having the spacer 7 applied thereon through a seal resin 10 comprising an epoxy resin and the like. Then, an insulating liquid 11 is injected between both of the substrates from an inlet 12 which is formed on the color filter substrate 16, and the inlet 12 is sealed by a sealing plate 13 made from an epoxy resin or the like.

The thin film EL panel of the present invention is obtained as described above.

When an AC voltage is impressed on the thin film EL panel thus fabricated, a yellowish orange light emitted from the EL layer 4 is separated into red and green by passing through the color filter 9 to provide a multi-color luminescence. Moreover, since a certain gap between the thin film EL element 14 and the color filter 9 is ensured by the spacer 7, both are not brought into contact together in the production and manufacturing steps. Therefore, it is possible to prevent the pixel defects due to the dielectric breakdown and the linear defects due to the breakage of the electrodes. Also, it is possible to dispose the spacer 7 by any of several very simple methods (i.e., applying it on the EL element substrate 15 using a dry application device) without the necessity of any photo process, photomask, and the like.

In addition to a dry application device, a wet application device and an electrostatic-type application device may be used as means for applying the spacer 7 on the EL element substrate 15.

Embodiment 2

It is preferred that the application density of the spacer 7 be uniform between the EL element substrate 15 and the color filter substrate 16. However, the spacer 7 may migrate during the injection of the insulating liquid 11 to cause unevenness of the application density. In order to prevent this problem, fixing the spacer 7 between the substrates may be considered.

The structure of the thin film EL panel in this embodiment is substantially the same as the structure of the panel in the embodiment 1 shown in FIG. 1 except that the spacer 7 is fixed between the substrates.

The following illustrate a process for producing the thin film EL panel of this embodiment.

First, an EL element 14, a color filter 9 and a black mask 18 are formed on an insulating substrate 1 and a transparent substrate 8, respectively by the same procedure as in the embodiment 1 to provide an EL element substrate 15 and a color filter substrate 16, respectively.

Then, plastic beads having a thermoplastic resin on their surface are applied on the color filter substrate 16 using a dry application device. Examples of such spacer include Micropearl CB (manufactured by Sekisui Fine Chemical, Corp.). Thereafter, the color filter substrate 16 is heated, for example at 140° C. for 30 minutes, and then allowed to spontaneously cool. The spacer 7 can be uniformly applied without being partially aggregated, and fixed by the subsequent heating. To confirm the spacer 7 is fixed on the substrate, nitrogen gas is blown onto the surface of the color filter substrate 16 on which the spacer 7 is applied. It is confirmed that the spacer 7 is fixed on the substrate when the spacer is not blown away.

Then, the color filter substrate 16 is superposed on the EL element substrate 15 through a seal resin 10 by the same procedure as in the embodiment 1. Then, an insulating liquid 11 is injected between both of the substrates from an inlet 12 which is formed on the color filter substrate 16, and the inlet 12 is sealed by a sealing plate 13.

The thin film EL panel of the present invention can be obtained as described above.

In the thin film EL panel according to this embodiment, it is possible to fix the spacer 7 between the EL element substrate 15 and the color filter substrate 16. Therefore, it is possible to prevent the spacer 7 from migrating during the injection of the insulating liquid 11 to cause the unevenness of the application density.

In such a case as this embodiment where plastic beads having a thermoplastic resin on their surface are used as the spacer 7, it is not preferred to apply them on the EL element which is susceptible to the breakages due to foreign materials, since the resin is sagged and brought into contact with a larger area of the substrate during heating and fixing them on the substrate. Therefore, the spacer 7 is instead applied on the color filter substrate 16 in this embodiment.

Embodiment 3

Figure 5:
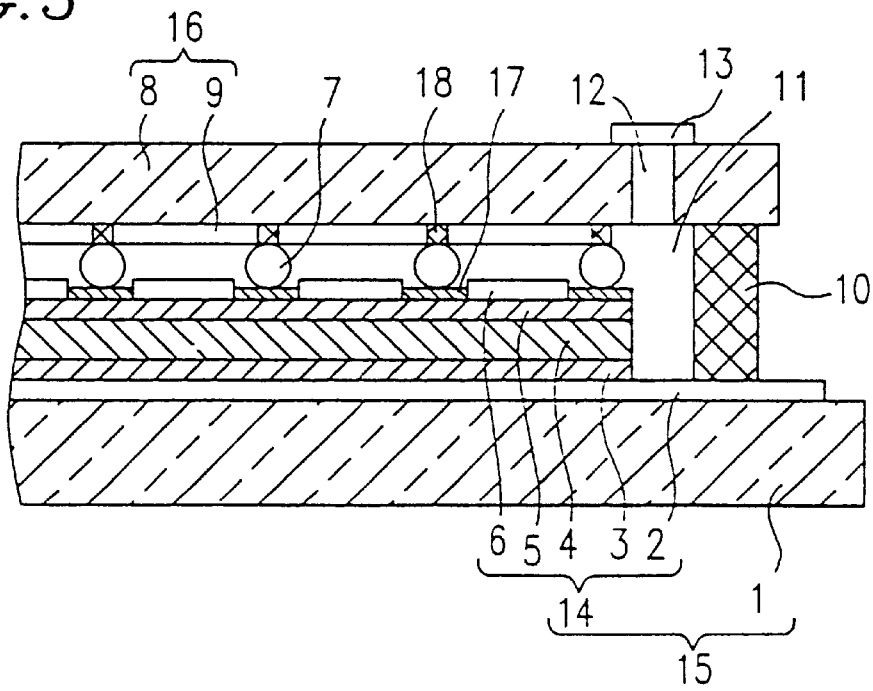
FIG. 5 is a sectional view showing another embodiment of the thin film EL panel of the present invention.

Another embodiment of the present invention is illustrated with reference to FIG. 5. The thin film EL panel of this embodiment is substantially the same as the panels of the above-described embodiments 1 and 2 except that the spacer 7 is fixed between the adjacent upper electrodes 6.

The following illustrate a process for producing the thin film EL panel of this embodiment.

First, an EL element 14, a color filter 9 and a black mask 18 are formed on an insulating substrate 1 and a transparent substrate 8, respectively by the same procedure as in the embodiment 1 to provide an EL element substrate 15 and a color filter substrate 16, respectively.

Then, an adhesive layer 17 comprising an epoxy resin or the like is formed on a portion or an entire area between the adjacent upper electrodes 6 of the EL element substrate 15 by a screen printing, or the like. Examples of such adhesive agent include Stractbond XN-21S (manufactured by Mitsui Toatsu Kagaku, Corp.). Thereafter, plastic beads are applied as a spacer 7 on the EL element substrate 15 using a dry application device. Examples of such spacer include Micropearl SP (manufactured by Sekisui Fine Chemical, Corp.). Thereafter, the EL element substrate 15 is heated, for example at 170° C. for 90 minutes. Moreover, the spacer 7 which is applied on the pixel is removed by blowing with nitrogen gas, or the like. The spacer 7 is fixed between the adjacent upper electrodes 6 of the EL element substrate 15 in such a manner.

Thereafter, the color filter substrate 16 is superposed on the EL element substrate 15 using a seal resin 10 by the same procedure as in the embodiment 1. Then, an insulating liquid 11 is injected between both of the substrates from an inlet 12 which is formed on the color filter substrate 16, and the inlet 12 is sealed by a sealing plate 13.

The thin film EL panel of the present invention can be obtained as described above.

The stripe-shaped color filters 9 formed on the color filter substrate 16 may not be superposed, and then the adhesive layer 17 may be formed between the adjacent color filters 9, and then the spacer 7 may be applied on the color filter substrate 16.

Since the thin film El panel of this embodiment comprises the spacer 7 fixed between the adjacent upper electrodes 6, it causes no minute breakages even after long-term use to improve the reliability of the EL element.

The method of fixing the spacer 7 between the adjacent upper electrodes 6 includes not only a method comprising forming the adhesive layer 17 between the adjacent upper electrodes 6 of the EL element substrate 15 or between the adjacent color filters 9 of the color filter substrate 16, and then applying the spacer 7 on the EL element substrate 15 or the color filter substrate 16 as described above, but also, for example, a method comprising first supplying a certain charge to the upper electrode 6 of the El element substrate 15 to impart the same polarity charge as that given in the upper electrode 6 of the EL element substrate 15 to the spacer 7, and then applying the spacer 7 on the EL element substrate 15. These application devices include, for example, SD-10 manufactured by Hightex International, Corp. In this case, because it is necessary to fix the spacer 7 which is applied between the adjacent upper electrodes 6 of the EL element substrate 15, a surface-adhesive spacer is used. For example, where plastic beads having a thermoplastic resin on their surface are used as the surface-adhesive spacer, the spacer 7 can be fixed by applying the beads on the EL element substrate 15, thereafter heating the substrate 15, and then allowing it to spontaneously cool. Thus, even in the case of using the surface-adhesive spacer, if it is possible to apply the spacer in only portions other than the pixel of the EL element substrate 15, it may be applied on the EL element substrate 15.

As described above, it is possible to apply the spacer 7 between the adjacent upper electrodes 6 without any increase of the process steps, in the case of imparting the same polarity charge in both the upper electrode 6 of the EL element substrate 15 and the spacer 7 and then applying the spacer on the EL element substrate 15.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A thin film EL panel, comprising an EL element substrate having a thin film EL element with a plurality of pixels, a color filter substrate having a color filter and being disposed opposite to said EL element substrate through a gap, and a seal resin for sealing said gap formed on the periphery of the display region, wherein a spacer having a particle size of 15 to 120 $\mu$m is interposed in said gap between said EL element and said color filter substrate.

2. The thin film EL panel of claim 1, wherein the application density of said spacer is 0.01 to 10 particles/$mm^2$.

3. The thin film EL panel of claim 1, wherein said seal resin is a thermosetting resin, and the thermal decomposition temperature of said spacer is higher than the thermosetting temperature of said thermosetting resin.

4. The thin film EL panel of claim 1, wherein said spacer is fixed on said EL element.

5. The thin film EL panel of claim 1, wherein said EL element comprises a lower electrode, a lower insulating film, an EL layer, an upper insulating film and an upper electrode successively laminated on a substrate.

6. The thin film EL panel of claim 5, wherein said spacer is fixed between the adjacent upper electrodes of said EL element.

* * * * *